US009151003B2

(12) United States Patent
Graham et al.

(10) Patent No.: US 9,151,003 B2
(45) Date of Patent: Oct. 6, 2015

(54) SYSTEM AND METHOD FOR SCREED ENDGATE CONTROL

(75) Inventors: Luke Edward Graham, Maple Grove, MN (US); Ricky Mings, Andover, MN (US); Todd Michael Jennings, Ramsey, MN (US); Jameson Michael Smieja, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 13/599,071

(22) Filed: Aug. 30, 2012

(65) Prior Publication Data

US 2014/0064847 A1 Mar. 6, 2014

(51) Int. Cl.

| | |
|---|---|
| ***E01C 23/00*** | (2006.01) |
| ***E01C 19/48*** | (2006.01) |
| *E01C 23/07* | (2006.01) |

(52) U.S. Cl.

CPC ..... *E01C 19/48* (2013.01); *E01C 23/07* (2013.01); *E01C 2301/16* (2013.01)

(58) Field of Classification Search

CPC ..... E01C 23/07
USPC ..... 404/84.05–84.8, 118, 108
See application file for complete search history.

(56) References Cited

U.S. PATENT DOCUMENTS

| | | | | |
|---|---|---|---|---|
| 2,699,949 | A | 1/1955 | Neighbour | |
| 3,071,049 | A * | 1/1963 | Pietro Pizzarotti et al. | 404/75 |
| 3,680,451 | A * | 8/1972 | Birtchet | 404/104 |
| 5,096,331 | A * | 3/1992 | Raymond | 404/118 |
| 5,201,603 | A * | 4/1993 | Bassett et al. | 404/84.1 |
| 5,356,238 | A * | 10/1994 | Musil et al. | 404/84.1 |
| 5,452,966 | A | 9/1995 | Swisher, Jr. | |
| 6,238,136 | B1 * | 5/2001 | Sovik et al. | 404/87 |
| 6,318,928 | B1 * | 11/2001 | Swearingen | 404/72 |
| 7,316,520 | B2 * | 1/2008 | Grubba | 404/84.05 |
| 7,354,221 | B2 * | 4/2008 | Congdon | 404/84.1 |
| 7,909,534 | B1 * | 3/2011 | Comer et al. | 404/118 |
| 7,946,787 | B2 * | 5/2011 | Glee et al. | 404/84.8 |
| 8,112,242 | B2 * | 2/2012 | Troxler | 702/127 |
| 2007/0098496 | A1 | 5/2007 | Hall et al. | |

* cited by examiner

*Primary Examiner* — Raymond W Addie
(74) *Attorney, Agent, or Firm* — Miller, Matthias & Hull LLP

(57) ABSTRACT

A system and method for controlling operation of an endgate of a screed paving machine using a control device is disclosed. The at least one control device may have a plurality of endgate controls and may be employed for issuing commands to a controller by an operator for controlling operation of the at least one endgate and operate the at least one endgate in an up mode and a down mode, changing the fore/aft pitch of the at least one endgate in tilt-up and tilt-down modes and operating the at least one endgate in auto-on and auto-off modes.

20 Claims, 9 Drawing Sheets

SYSTEM AND METHOD FOR SCREED ENDGATE CONTROL

TECHNICAL FIELD OF THE DISCLOSURE

This present disclosure relates generally to paving machines and, more particularly, to a system and method for controlling operation of the endgates of a screed paving machine using a control device.

BACKGROUND OF THE DISCLOSURE

Paving machines are generally used for laying heated paving material, such as, bituminous aggregate mixtures or asphalt, onto a roadbed or other ground surface. After heated asphalt is laid, it is spread, leveled and compacted such that upon cooling, a surface with a uniform, smooth surface that becomes passable by vehicles is achieved. In order to spread the heated asphalt, a paving machine, known as a screed, is typically used. Such screeds can be pulled by a tractor, truck or the like or can be self-propelled. The truck or the tractor supplies the asphalt from a hopper to screw augers, which transport the asphalt material laterally in front of screed elements that heat, compress, compact and manipulate the asphalt downwardly to form a "mat" of paving material, ideally of uniform thickness and surface finish.

Conventional screed elements are of a set width. However, in certain paving applications, such as driveways, parking lots, and the like, varying the asphalt mat width may be desired. As a result, width-adjustable or extendable screed arrangements have become common for varying the width of the asphalt mat without interrupting the paving process. Typically, extendable screeds consist of a main screed element of a fixed width and hydraulically extendable screed elements that are capable of extending from each end of the main screed element. Screed elements may be equipped with endgates that act to contain the asphalt material in front of the screed elements and not allow the asphalt material to migrate laterally past the endgates.

During normal operation of the screed, an operator typically makes several adjustments to the angle of attack of the screed elements to affect the depth of the asphalt mat being laid. To maintain the asphalt material between the endgates as the depth of the asphalt mat is adjusted, the endgates may be extended (e.g., lowered) or retracted (e.g., raised). An often desired position of the endgate is a sliding contact with the surface being paved upon. Also, an endgate may need to be extended to ride on top of a curb, while the surface next to the curb is paved. When the asphalt mat thickness changes incrementally or the surface being paved upon becomes uneven, the endgates may be operated to adjust them to float at the new paving depth.

Thus, depending upon the requirements of the surface being paved, an operator must continually adjust the endgate height to maintain the endgate in the correct position. Conventionally, the endgates are operated and adjusted manually using handcranks that are provided on each endgate. While handcranks indeed work to vary the height of the endgates, several disadvantages are associated with this method. For example, an operator typically walks along the screed to observe the surface that is being paved and based on their observation (e.g., uniformity of the surface) and the thickness of the mat that is desired, the operator may change the height of the endgates. For manually operating the endgates, the operator must go back to the endgates and manually operate the handcranks for changing the height of the endgates. This process is not only time consuming, it also relies on the correct operation of the handcranks, which are subject to breaking down given their frequent use throughout the day in a paving process.

Accordingly, there exists a need for a reliable and easy to use system and method for adjusting the height of the endgates of screed paving machines. It would be beneficial if such a system and method could be used by an operator to adjust the height of the endgates while walking alongside the screed.

SUMMARY OF THE DISCLOSURE

In accordance with one aspect of the present disclosure, a system for controlling operation of an endgate of a screed paving machine is disclosed. The system may include at least one endgate having a frame and a wall connected to the frame, at least one cylinder configured to operate the at least one endgate by moving the wall of the at least one endgate relative to the frame and at least one control valve for actuating the at least one cylinder. The system may also include at least one control device for issuing commands by an operator for controlling operation of the at least one endgate, the at least one control device configured to communicate with a controller, the controller in turn configured to communicate with the at least one control valve for actuating the at least one cylinder. The at least one control device may also include a plurality of endgate controls for operating the at least one endgate in an up mode and a down mode, changing the fore/aft pitch of the at least one endgate in a tilt-up mode and a tilt-down mode and operating the at least one endgate in an auto-on mode and an auto-off mode.

In accordance with another aspect of the present disclosure, a method of controlling operation of an endgate of a screed paving machine is disclosed. The method may include providing (a) at least one endgate having a frame and a wall connected to the frame and (b) at least one hand-held control device having a plurality of endgate controls for issuing commands by an operator for remotely controlling operation of the at least one endgate, the plurality of endgate controls configured to operate the at least one endgate in an up mode and a down mode, changing the fore/aft pitch of the at least one endgate in a tilt-up mode and a tilt-down mode and operating the at least one endgate in an auto-on mode and an auto-off mode. The method may also include actuating at least one of the plurality of endgate controls by the operator and sending a first command to a controller in communication with the at least one control device and sending a second command by the controller to operate the at least one endgate in one of the up mode, the down mode, the tilt-up mode, the tilt-down mode, the auto-on mode and the auto-off mode.

In accordance with yet another aspect of the present disclosure, a control system for remotely controlling operation of an endgate of a screed assembly is disclosed. The control system may include a control device having a plurality of endgate controls including an up button, a down button, a tilt-up button, a tilt-down button and an auto button for at least one of raising, lowering and tilting an endgate connected at either ends of the screed assembly. The control system may also include a controller in communication with the control device, the controller configured to receive commands from the control device and further configured to send commands to control operation of the endgate. These and other aspects and features of the present disclosure will be more readily understood upon reading the following description when taken in conjunction with the accompanying drawings.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION OF THE DISCLOSURE

The present disclosure provides a system and method to control operation of the endgates of a screed paving machine utilizing a hand held control device, as described in detail below.

Figure 1:
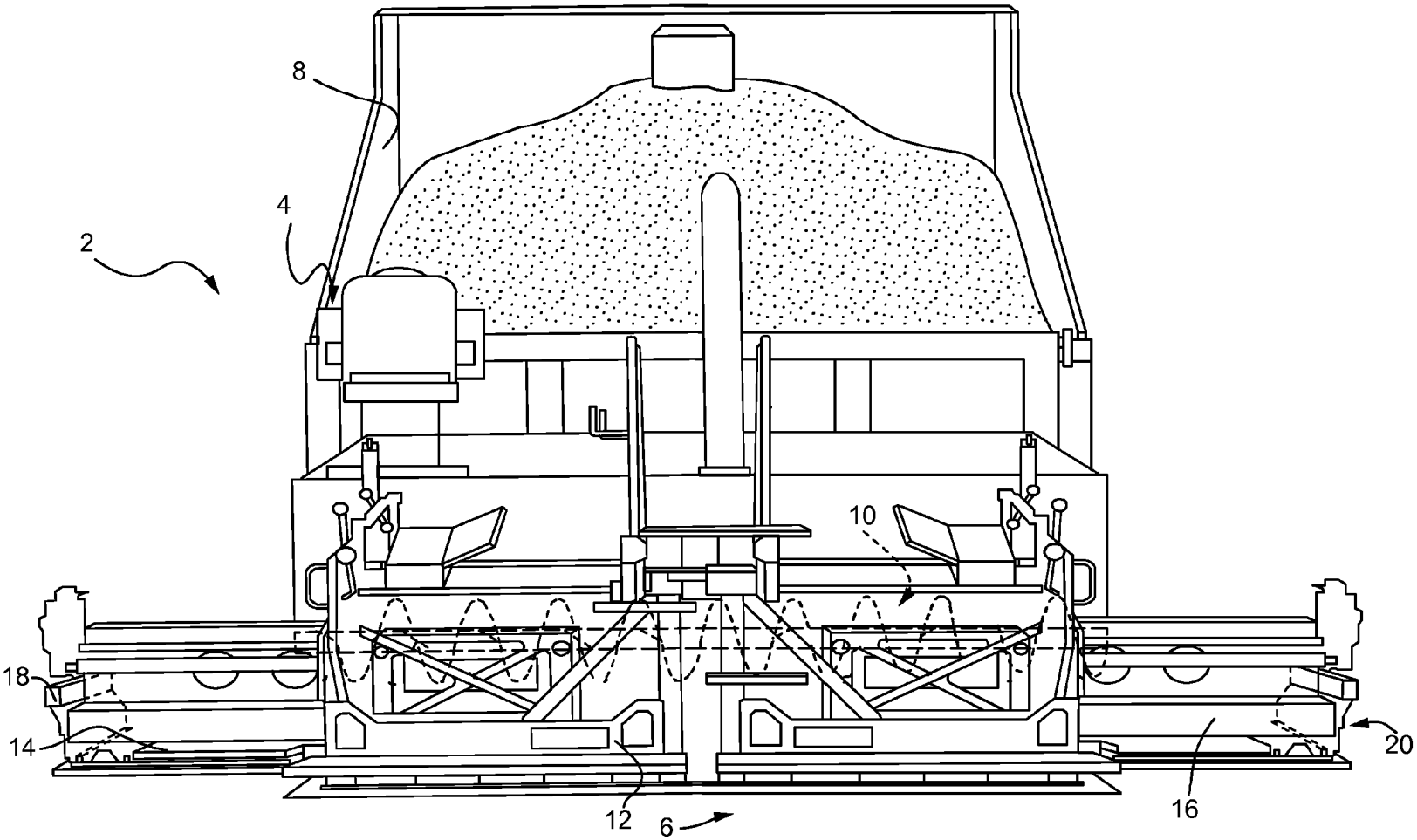
FIG. 1 is a perspective view of an exemplary paving machine constructed in accordance with at least some embodiments of the present disclosure.

Referring to FIG. 1, an exemplary paving machine 2 is schematically shown, in accordance with at least some embodiments of the present disclosure. It will be understood that only those components that are essential for a proper understanding of the present disclosure are shown and/or described herein. Nevertheless, several other components that are commonly employed in combination or conjunction with such paving machines are contemplated and considered within the scope of the present disclosure.

Thus, as shown, the paving machine 2 may include a tractor 4 towing a screed assembly 6. The tractor 4 may include a plurality of ground engaging elements (not visible) for moving the tractor 4 and the screed assembly 6 on a reference surface (e.g., on a roadbed). The ground engaging elements may be wheels with tires, endless tracks, a combination of wheels and tracks or any other device for moving the tractor 4 and the screed assembly 6. The tractor 4 may also include a hopper 8 for receiving and temporarily storing a supply of asphalt, as well as feeding conveyors or screw augers 10 for moving the asphalt from the hopper to the screed assembly 6.

Once the asphalt reaches the screed assembly 6, the screed assembly may compress, level and shape the asphalt into a layer of desired thickness, size and uniformity. To do so, the screed assembly 6 may employ a number of screed elements, such as, a main screed element 12 and left and right screed extenders 14 and 16 for extending the paving width of the asphalt mat being laid down. Bolt-on extensions extending from the left and right screed extenders 14 and 16, respectively, may also be provided to further increase the paving width. Additionally, the screed assembly 6 may include a left endgate 18 that flanks the left screed extender 14 (or the left bolt-on extension when present) and a right endgate 20 that flanks the right screed extender 16 (or the right bolt-on extension when present) in order to prevent lateral movement of the asphalt beyond the screed elements.

Figure 2A:
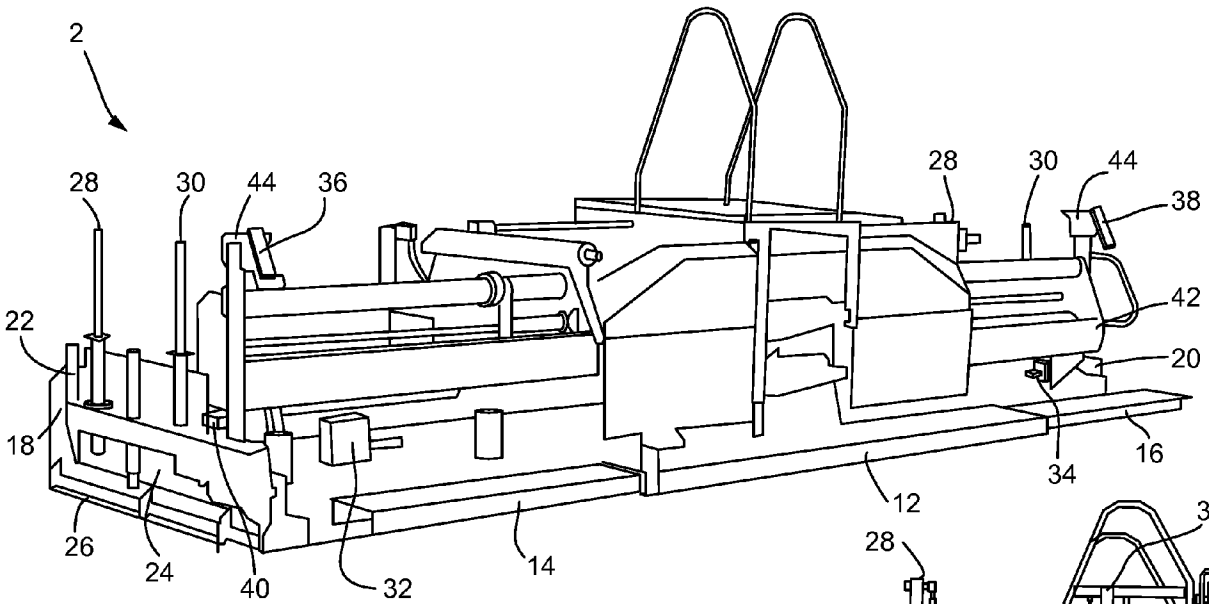
FIG. 2A is a partial perspective view showing endgates of the paving machine of FIG. 1.
Figure 2B:
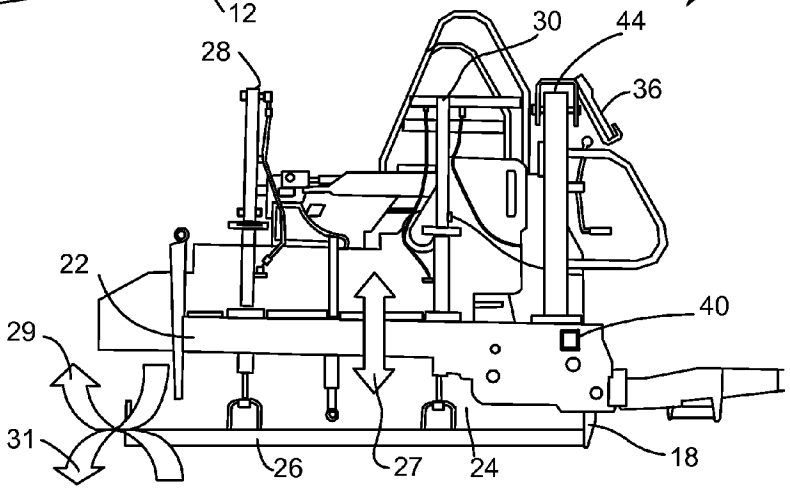
FIG. 2B is an end view of one of the endgates of FIG. 2A illustrating the motion of that endgate in various directions.

Turning now to FIGS. 2A and 2B, the left and right endgates 18 and 20 (also referred to herein as just "endgates"), respectively, are described in greater detail. Specifically, the endgates 18 and 20 may each include a frame 22 to which may be mounted (or integrally formed therewith) a wall 24 having a shoe 26 (the frame, wall and shoe of only the left endgate is visible in FIGS. 2A and 2B). The wall 24 and the shoe 26 are capable of retracting and extending relative to the frame 22 for respectively raising and lowering the endgates 18, 20, as well as tilting up or down for adjusting the fore/aft pitch of the endgates. The up and down motion of the endgates 18 and 20 is shown by arrow 27 in FIG. 2B and the tilting up motion is shown by arrow 29. Relatedly, the tilting down motion of the endgates 18 and 20 is shown by arrow 31 in FIG. 2B. Each of the up, down, tilt-up and tilt-down motion of the endgates 18, 20 is described in greater detail below. By virtue of raising, lowering or tilting the endgates 18 and 20, the endgates may be kept in engagement with or kept sliding over the ground line of the reference surface and keep the asphalt in front of the screed elements and between the endgates.

Furthermore, each of the endgates 18 and 20 may be provided with a pair of hydraulically actuatable actuators or cylinders 28 and 30 (including a front cylinder and a rear cylinder). The cylinders 28 and 30 may be actuated independently for raising, lowering or tilting the endgates 18 and 20. The cylinders 28 and 30 may be controlled by way of electrohydraulic control valves 32 and 34. In at least some embodiments and, as shown, the control valve 32 may be employed for independently controlling the cylinders 28 and 30 of the left endgate 18, while the control valve 34 may be employed for independently controlling the cylinders of the right endgate 20. Notwithstanding the fact that both of the cylinders 28 and 30 are described as being controlled by one of the control valves 32 and 34, in at least some embodiments, each of the cylinders 28 and 30 may be controlled by its own dedicated control valve. Other configurations of the cylinders 28 and 30 and the control valves 32 and 34 may be employed as well in other embodiments. By virtue of operating the control valves 32 and 34, the fluid flow and, therefore, the pressure within the cylinders 28 and 30 may be varied to control the endgates 18 and 20.

The control valves 32 and 34 may in turn be controlled by control devices 36 and 38, respectively. Specifically, the height and angle of the left endgate 18 may be adjusted (e.g., raised or lowered) by sending commands (e.g., digital signals) from the control device 36, to the control valve 32, while the height and angle of the right endgate 20 may be adjusted (e.g., raised, lowered) by sending commands (e.g., digital signals) from the control device 38 to the control valve 34. In at least some embodiments, both the left and right endgates 18 and 20, respectively, may be controlled by a single control device as well. The control devices 36 and 38 may be operated by an operator to manipulate the endgates 18 and 20 while walking alongside the screed assembly 6 and observing the pavement being laid, as further described below.

The control devices 36 and 38 may each communicate with its own dedicated controller 40 and 42, respectively, as shown, or alternatively with a single main machine controller of the tractor 4. Furthermore, in at least some embodiments, the controllers 40 and 42 may be mounted within or attached to the frame 22 of the endgates 18 and 20 as shown, or within frames of the screed extender elements 14 and 18, frame of the main screed element 12, or the tractor 4. The controllers 40 and 42 may be stand-alone embedded or general purpose processing systems having any of a variety of volatile or non-volatile memory/storage devices, such as, flash memory, read only memory (ROM), programmable read only memory (PROM), erasable programmable read only memory (EPROM), electronically erasable programmable read only memory (EEPROM), etc., processing devices and computer readable media, such as, joy sticks, flash drives, optical disc drives, floppy discs, magnetic tapes, drums, cards, etc., as well as output and display devices such as monitors and printers. Other types of computing, processing as well as reporting and storage devices may be present within (or used in conjunction with) the controllers 40 and 42. Additionally, the controllers 40 and 42 may be capable of communicating with the control valves 32 and 34 for controlling the cylinders 28 and 30 for raising, lowering, or tilting the endgates 18 and 20 by way of wired or wireless links or buses.

Furthermore and as described above, while the controllers 40 and 42 have been shown to be dedicated controllers mounted to or within the frame 22 of the endgates 18 and 20, in at least some embodiments, the controllers may be part of operator interface devices and/or other control systems provided on or in conjunction with the paving machine 2 and mounted elsewhere on the tractor 4. It will also be understood that while a dedicated one of the controllers 40 and 42 for the control devices 36 and 38, respectively, has been shown and described in the present embodiment, this need not always be the case. In at least some embodiments, a single controller capable of controlling both the control devices 36 and 38 may be employed as well.

Figure 3:
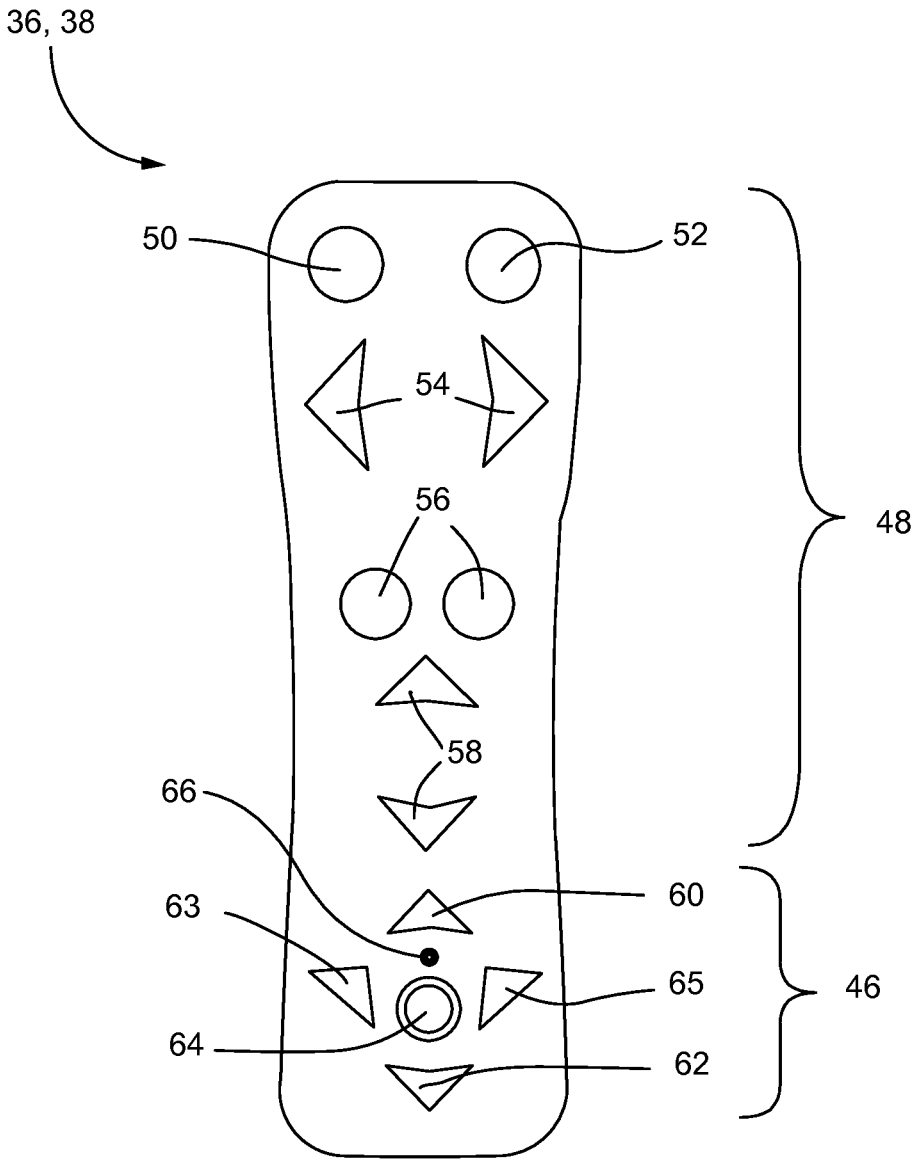
FIG. 3 is an exemplary schematic illustration of a hand held control device employed for controlling the endgates of the paving machine of FIG. 1.

Referring now to FIG. 3, a schematic illustration of the control devices 36 and 38 is shown, in accordance with at least some embodiments of the present disclosure. As discussed above, the control devices 36 and 38 may be employed for controlling the endgates 18 and 20, by issuing various commands to their associated controllers 40 and 42, which in turn may control the control valves 32 and 34 for lowering, raising or tilting the endgates. In at least some embodiments, the control devices 36 and 38 may be hand-held control devices capable of communicating with the controllers 40 and 42 via cables or harnesses, radio channels, links involving the internet or the World Wide Web, satellite (e.g., global positioning systems), cellular or any other mode of tethered/wired or wireless communication methods.

The control devices 36 and 38 may be stored in holsters 44 (See FIG. 2) provided near the endgates 18 and 20 when not in use. Each of the control devices 36 and 38 may have a set of endgate controls 46 along with a plurality of other controls 48, which are described briefly below. It will be understood that one or both set of controls 46 and 48 may be any of a variety of buttons, rollers, sliders, knobs, switches etc., or a combination thereof. The control devices 36 and 38 may also have light emitting diode (LED) devices, display monitors, illustrations and other mechanisms to provide various notifications, signals, warnings, readings, etc. to the operator of the control device(s).

With respect to the controls 48, in at least some embodiments, they may include an emergency shutdown button 50 for stopping operation of at least a portion of the screed assembly 6, a horn button 52 for alerting another operator, screed extension rollers or buttons 54 for moving the screed extenders 14 and 16, as well as any bolt-on extenders in and out of the main screed element 12. The controls 48 may also include over-ride buttons 56 for varying the speed of the screw augers 10 for reducing or increasing the speed with which material is delivered from the hopper 8 to the screed assembly 6, as well as tow arm buttons 58 for manipulating the height of the tow arms which connect the screed assembly 6 to the tractor 4 for varying the thickness of the paved material that is laid down.

Notwithstanding the controls 48 described above, it will be understood that several controls in addition or alternative to those described above may be present on one or both of the control devices 36 and 38. It will also be understood that although the control devices 36 and 38 have been described as being identical to one another, this need not always be the case. Rather, in some embodiments, the control devices 36 and 38 may have at least some controls that are different from one another.

Referring still to FIG. 3, the endgate controls 46 may include buttons for moving the endgates 18 and 20 up or down, tilting the endgates to adjust the fore/aft pitch of the wall 24 or the shoe 26, or for putting the endgates in an auto mode. Thus, the endgate controls 46 may include an up button 60 for raising the endgate 18 or 20, a down button 62 for lowering the endgates, an auto button 64 for automatically adjusting the height and angle of the endgates, a tilt-up button 63 for tilting the endgates in an upward direction and a tilt-down button 65 for tilting the endgates in a downward direction. The up or the down buttons 60 or 62, respectively, may be pressed multiple times to raise or lower the height of the endgates 18 and 20 in small increments, with each press of a button being associated with one increment. Similarly, the tilt-up or tilt-down buttons 63 or 65, respectively, may be pressed several times to tilt the endgates up or down in smaller increments. The endgate controls 46 may also include an LED 66 for indicating the status of the auto button 64, that is, whether the auto-mode of the endgates 18 and 20 is on or not.

By virtue of manipulating the buttons 60-65, the endgates 18 and 20 can be controlled to provide six modes of operation, namely, moving the endgates up in an up mode, moving the endgates down in a down mode, auto-on mode for automatically adjusting the correct position of the endgates depending upon the uniformity of the reference surface being paved, auto-off mode for turning the auto-on mode off, tilting the endgates in an upward direction in a tilt-up mode and tilting the endgates in a downward direction in a tilt-down mode. Each of the six modes of operation is described below in FIGS. 4-9. Furthermore, the endgates 18 and 20 can be independently controlled such that when one endgate is in one mode of operation, the other endgate is in another mode of operation.

Industrial Applicability

Thus, the present disclosure sets forth a system and method for controlling the endgates of a screed assembly using hand-held control device(s). The control devices may be tethered to the paving machine or communicate wirelessly therewith. The control device(s) may also be provided with several endgate controls that may be actuated to control the operation of the endgates, as described below.

Figure 4:
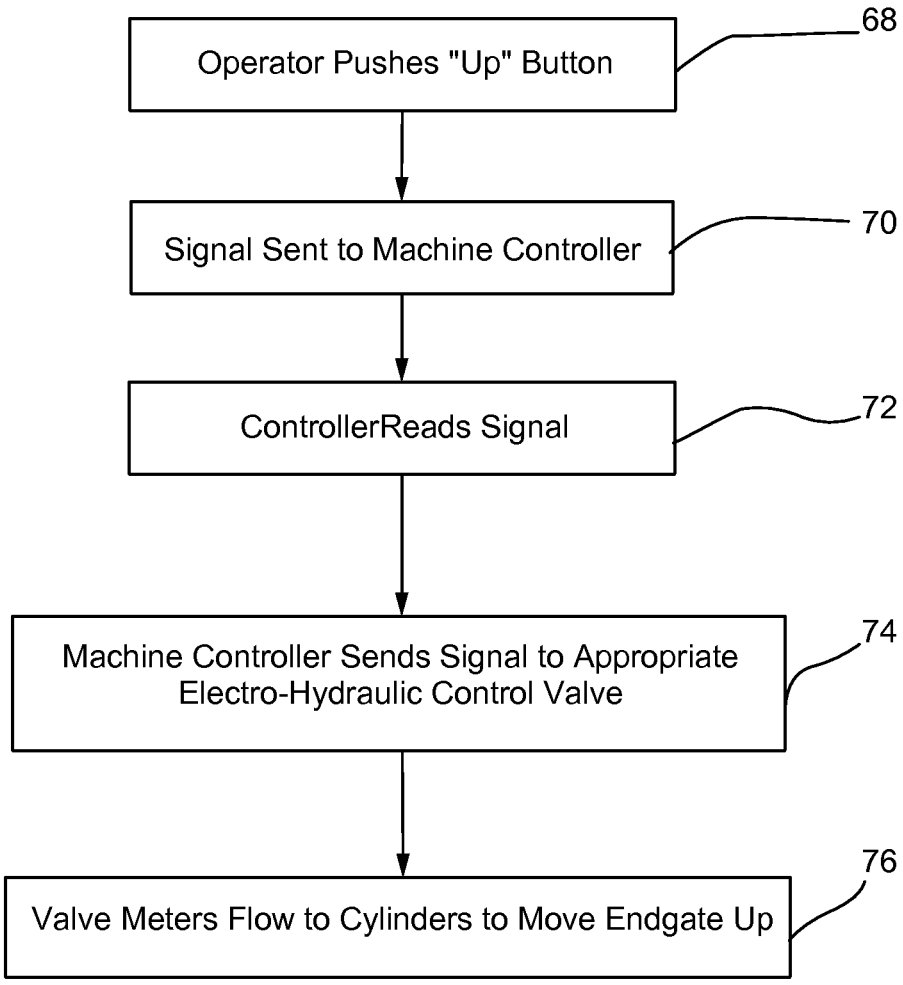
FIG. 4 is an exemplary flowchart showing steps of operating the endgates when a first command is issued by the control device of FIG. 3.

Referring now to FIG. 4, an exemplary flowchart describing steps of operation for moving the endgates 18 and/or 20 up in the up mode is shown, in accordance with at least some embodiments of the present disclosure. For purposes of description only, the steps in FIGS. 4-9 are explained with respect to the control device 36 communicating with the controller 40 and controlling the control valve 32, which in turn controls the cylinders 28 and 30 of the left endgate 18. However, similar steps of operation will be applicable to the right endgate 20. Thus as shown in FIG. 4, the process starts at a step 68 with the operator pushing (e.g., depressing) the up button 60 (See FIG. 3). Upon actuating the up button 60, the control device 36 may send a signal, for example, an up command, to the controller 40 at a step 70. As discussed above, the control device 36 may communicate with the controller 40 in any of a variety of commonly employed ways (e.g., digital signals).

Upon receiving the up command from the control device 36, the controller 40 may decode and read the command at a step 72. For example, each digital signal received by the controller 40 may be a unique signal and may be representative of a unique binary code, which in turn may correspond to a specific command. Thus, by actuating the up button 60 at the step 68, a unique digital signal may be transmitted by the control device 36 to the controller 40, which in turn may decode the digital signal into a unique binary code programmed with a command for moving the endgate 18 up. To facilitate moving the endgate 18 up, the controller 40, upon decoding the signal from the control device 36, may send a signal to its associated control valve 32 at a step 74.

As discussed above, the controller 40 may be connected to the control valve 32 via a wired or a wireless connection and the control valve may be electro-hydraulically controlled. In at least some embodiments, the output from the controller 40 may actuate one or more solenoids that port hydraulic fluid through the control valve 32 appropriately in order to raise the endgate to maintain the shoe 26 in contact with the ground line or grade at all times. Subsequently then, at a step 76, the control valve 32 meters the flow of hydraulic fluid to the cylinders 28 and 30 as directed by the controller 40 to move the endgate 18 up in a direction shown by the arrow 27 in FIG. 2B.

Figure 5:
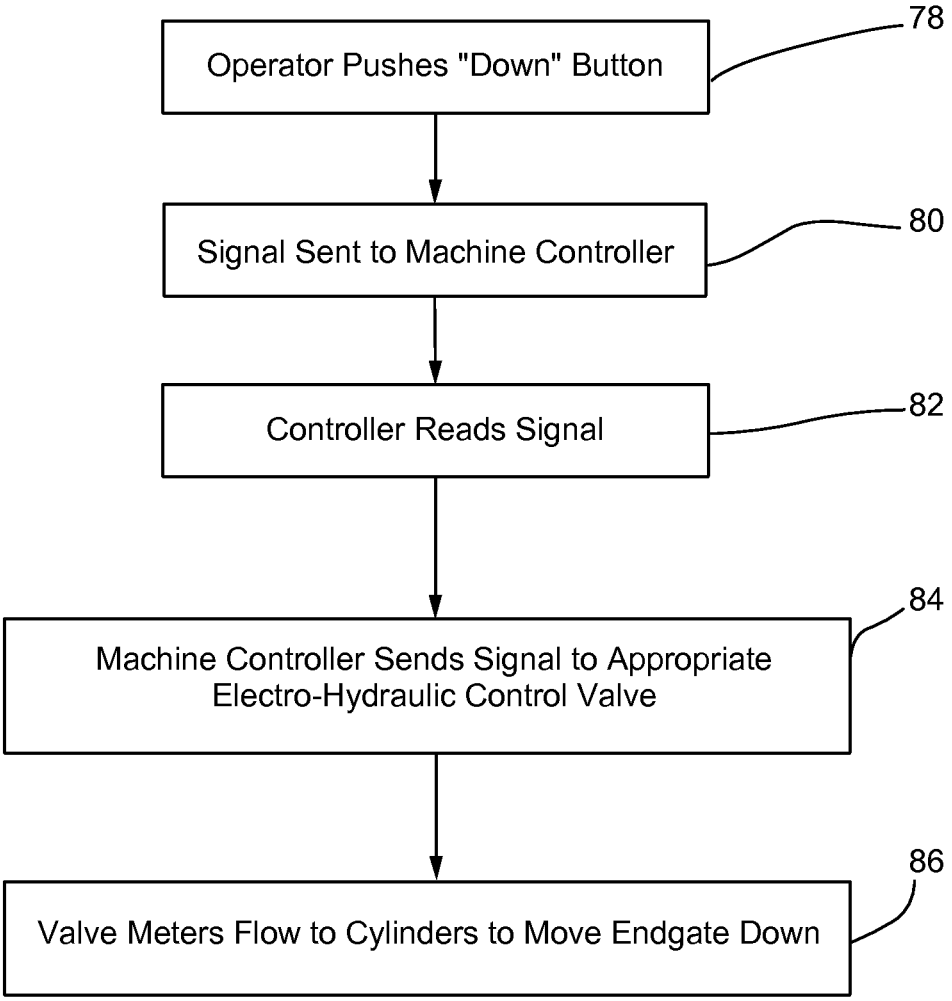
FIG. 5 is another exemplary flowchart showing steps of operating the endgates when a second command is issued by the control device of FIG. 3.

Similarly, the control device 36 may be employed to lower the endgate 18, as described in FIG. 5. Again, to operate the endgate 18 in the down mode, the operator may actuate (e.g., depress or push) the down button 62 at a step 78, which then sends a signal (e.g., a unique digital signal) to the controller 40 at a step 80. The controller 40 upon receiving the signal from the control device 36 may decode (e.g., determine the unique binary code) that signal at a step 82 and send another signal to the control valve 32 at a step 84 to lower the endgate 18 by actuating the appropriate solenoids associated therewith. The control valve 32 may then meter the flow of hydraulic fluid to the cylinders 28 and 30 to lower the endgate 18 at a step 86 in a direction shown by the arrow 27 in FIG. 2B.

Figure 6:
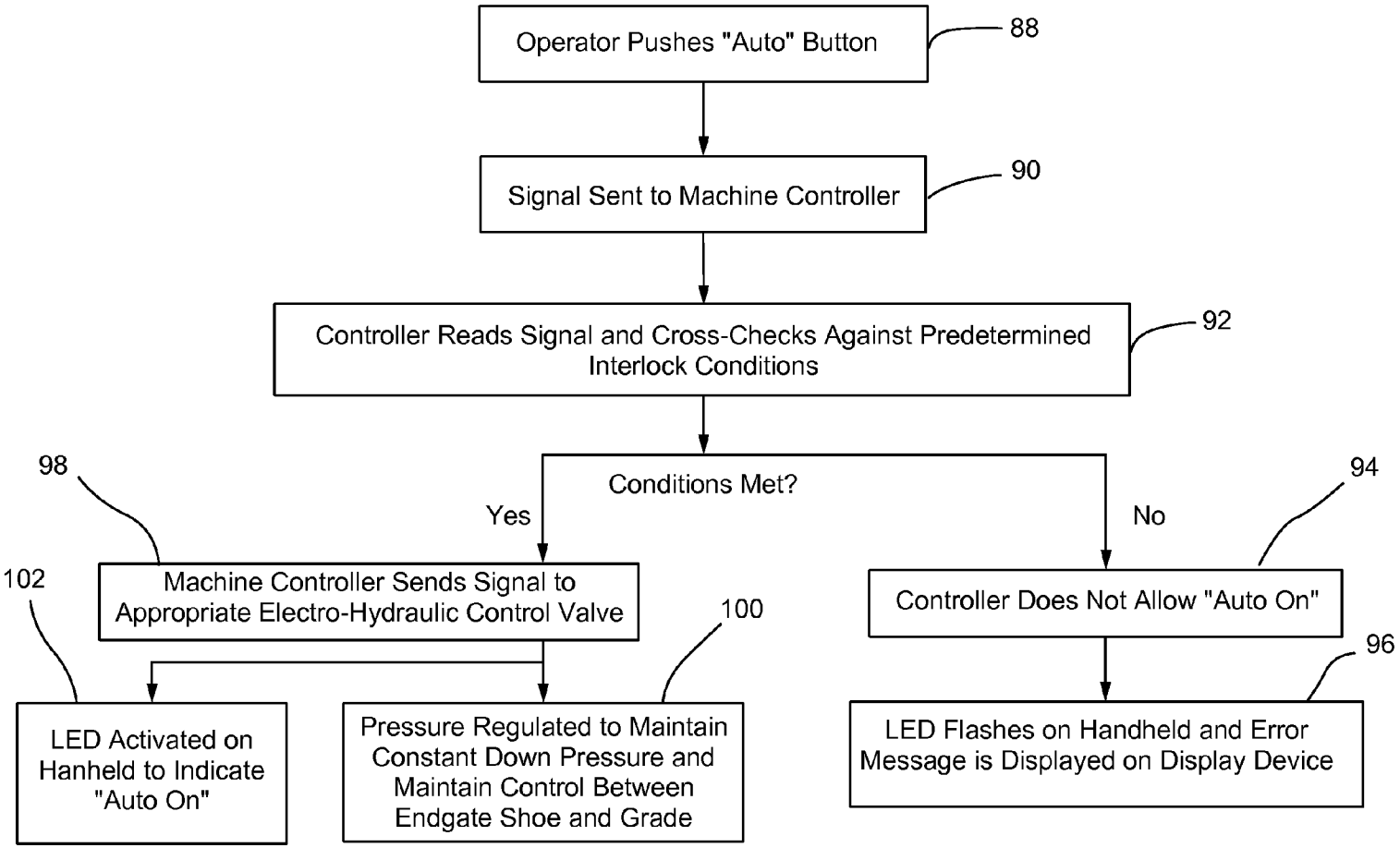
FIG. 6 is a yet another exemplary flowchart showing steps of operating the endgates when a third command is issued by the control device of FIG. 3.
Figure 7:
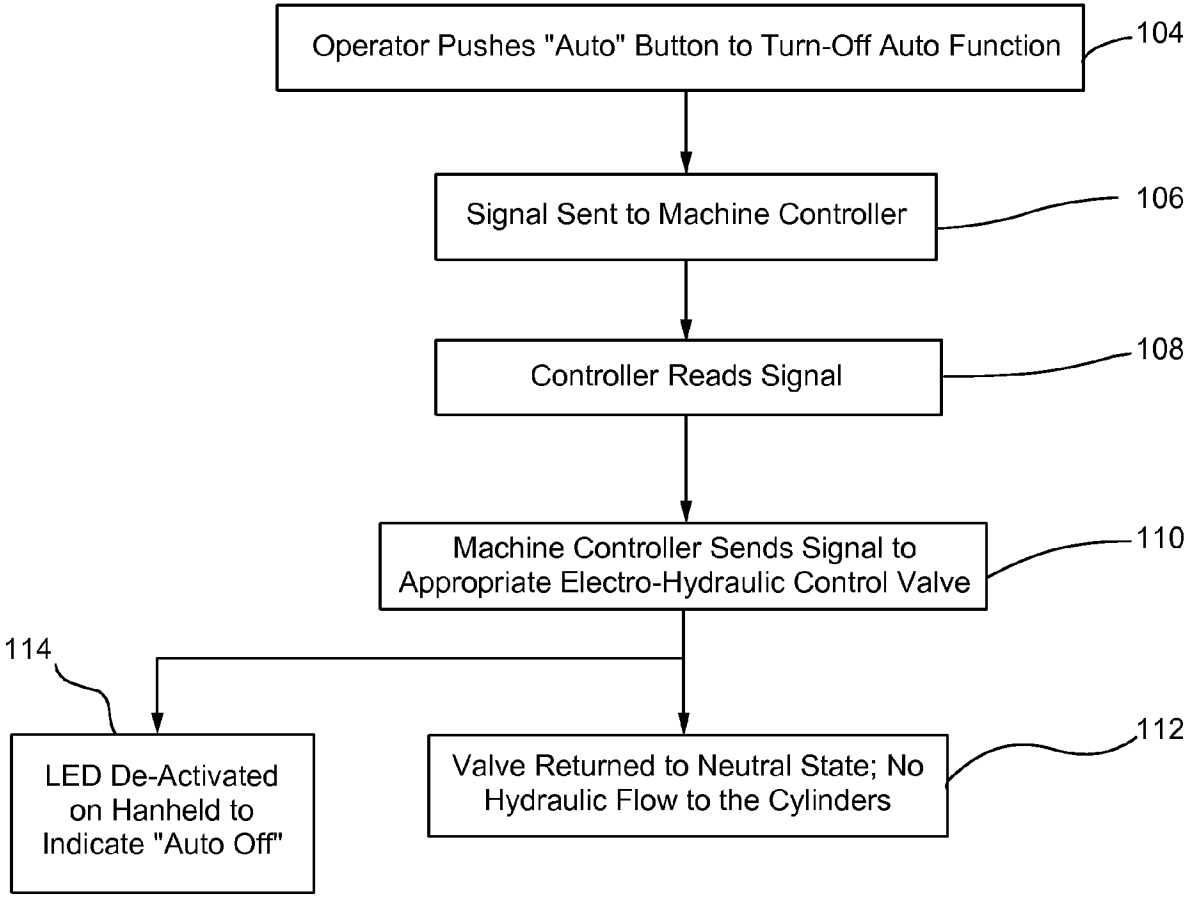
FIG. 7 is also an exemplary flowchart showing steps of operating the endgates when a fourth command is issued by the control device of FIG. 3.

Turning now to FIGS. 6 and 7, the auto-on and auto-off modes of operation of the endgate 18 will be described. Specifically, FIG. 6 shows an exemplary flowchart describing steps of operation of the auto-on mode, while FIG. 7 shows an exemplary flowchart describing the auto-off mode. Both, the auto-on and the auto-off modes, may be controlled by the auto button 64, as described below. Referring specifically to FIG. 6, the endgate 18 may be put into an auto-on mode by actuating (e.g., depressing or pushing) the auto button 64 at a step 88. Actuating the auto button 64 may send a signal (e.g., a digital signal) to the controller 40 at a step 90, which may then read and decode the signal (e.g., determine the corresponding binary code) at a step 92.

After decoding the signal, the controller 40 may cross-check against various interlock conditions that may be predetermined and pre-programmed within the controller 40. The interlock conditions are typically a series of machine conditions for both the screed assembly 6 and the paving machine 2 in general that prevent the endgate 18 from going into an auto-on mode unless all of those conditions are met.

If the inter-lock conditions are not met at the step 92, then the process proceeds to a step 94, where the controller 40 does not allow the endgate 18 to go into an auto-on mode (e.g., by not sending any signal to the control valve 32). Then, at a step 96, the controller 40 sends a signal back to the control device 36 and particularly to the LED 66, which flashes to indicate an error to the operator handling the control device. An error message may also be displayed if a display is provided on the control device 36 and the endgate 18 may remain in the same position as it was before the auto button 66 was actuated.

On the other hand, if at the step 92, the interlock conditions are met, then the process may proceed to a step 98 where the controller 40 sends a signal to the control valve 32 for manipulating the cylinders 28 and 30. At a step 100, the control valve 32 may regulate the flow of hydraulic fluid to the cylinders 28 and 30 for maintaining constant down pressure to keep the shoe 26 of the endgate 18 in contact with the ground line of the reference surface. The down pressure in the auto-on mode may be the same or different than the down pressure that is applied when the endgate 18 is lowered by actuating the down button 62. The endgate 18 may stay in the auto-on mode unless the operator turns the auto-on mode off. In addition, at a step 102, the LED 66 may be activated (by the controller 40 sending a signal to the control device 36) and turned on at a step 102 to indicate to the operator that the endgate 18 is operating in an auto-on mode.

Turning now to FIG. 7, the auto-on mode may be turned off by actuating the auto button 64 again. Specifically, if the auto-on mode is on (indicated by the constant on LED 66), then the auto-on mode may be turned off by the operator by actuating the auto button 64 at a step 104, which sends a signal (e.g., a digital signal) to the controller 40 at a step 106. Next, at a step 108, the controller 40 reads and decodes (e.g., determines the corresponding binary code) the signal and sends a signal to the control valve 32 at a step 110. When the control valve 32 senses an auto-off command from the controller 40, at a step 112, the control valve returns to a neutral state and no hydraulic fluid is caused to flow through the cylinders 28 and 30. The endgate 18 may stay in the neutral condition until another command is sent by the operator using the control device 36. Actuating the endgate up, down, or tilt buttons, while in auto-on may likewise disable the "auto" feature as may violating any of the interlock conditions required to initially activate auto-on.

In addition to sending a signal to the control valve 32 at the step 110, the controller 40 may also send a signal back to the control device 36 at a step 114 for de-activating the LED 66, which was turned on when the endgate was operated in an auto-on mode. A message indicating the auto-off mode may also be displayed on a display, when present, of the control device 36. Thus, the LED 66 may be employed for indicating the mode of operation of the endgate 18. For example, if the auto-on mode is requested but not permitted by the controller 40, the LED may flash briefly. If the auto-on mode is requested and permitted by the controller 40, the LED may be constantly on until the auto-off mode is activated, at which point the LED is turned off. In all other modes (up mode or down mode), the LED is turned off.

Figure 8:
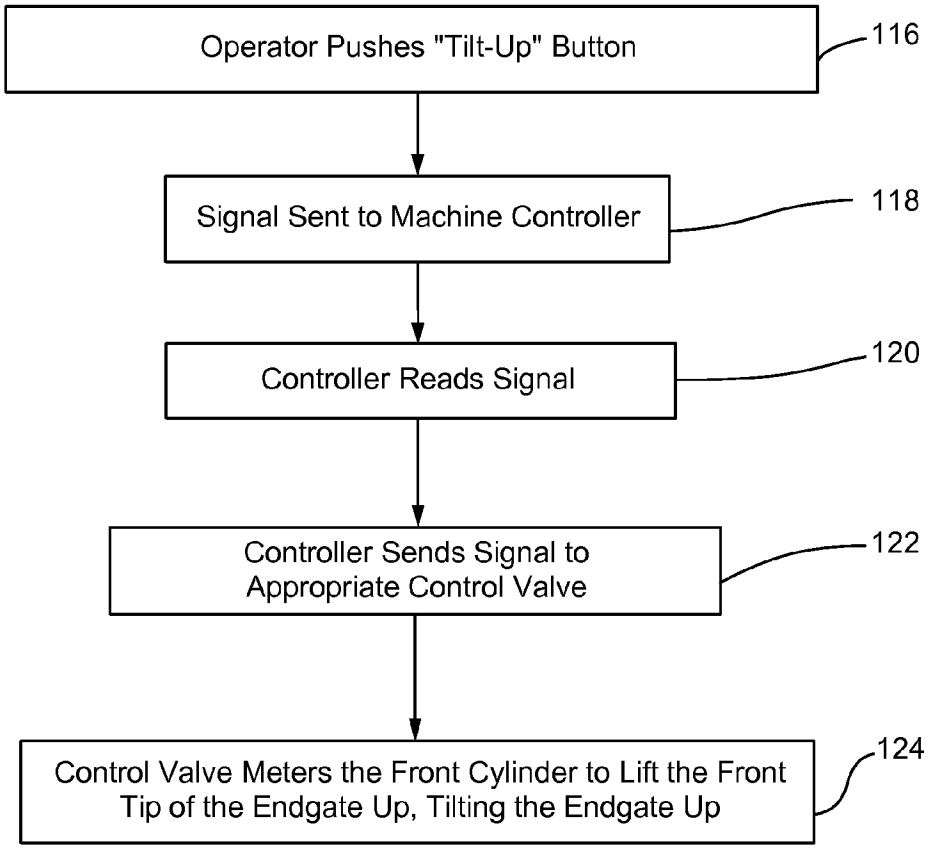
FIG. 8 is another exemplary flowchart showing steps of operating the endgates when a fifth command is issued by the control device of FIG. 3.
Figure 9:
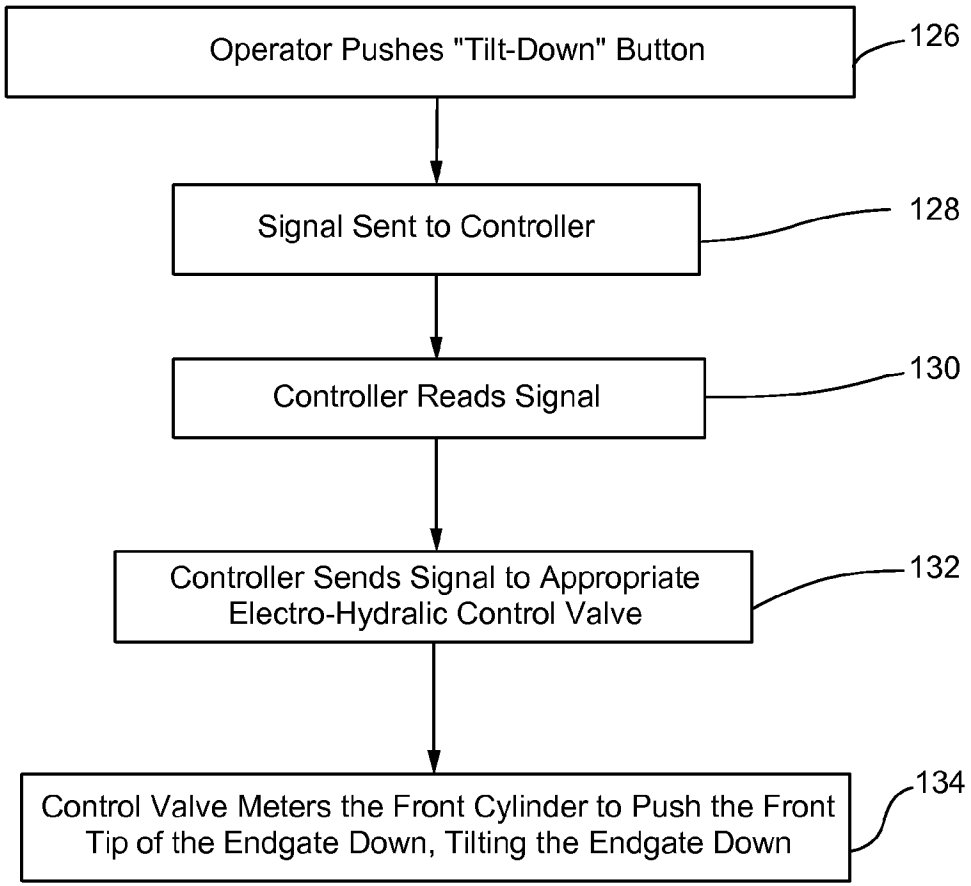
FIG. 9 is also an exemplary flowchart showing steps of operating the endgates when a sixth command is issued by the control device of FIG. 3.

Turning now to FIGS. 8 and 9, the tilt-up and tilt-down modes, respectively, of the endgates 18 and 20 will be described. As mentioned above, the tilt-up and tilt-down modes can be actuated by respectively actuating the tilt-up button 63 and tilt-down button 65. By virtue of tilting the endgates 18, 20, the fore/aft pitch of the endgates can be manipulated. Now referring specifically to FIG. 8, in order to tilt the endgate 18 up, the operator may begin by depressing the tilt-up button 63 on the control device 36 at a step 116 in order to send a command (e.g., digital signal) to the controller 40 at a step 118. At a step 120, the controller 40 reads and decodes (e.g., determine the unique corresponding binary code) the command from the control device 36 and at a step 122, the controller may command (e.g., by actuating the corresponding solenoids of) the control valve 32 by sending a signal thereto. In response to the signal received from the controller 40, the control valve 32 at a step 124 may meter flow to a front one of the cylinders 28, 30 in order to lift a front tip of the endgate 18 up in a direction shown by the arrow 29 in FIG. 2B. The rear one of the cylinders 28, 30 may not need to be actuated in order to tilt the endgate 18.

Thus, by actuating just one of the cylinders 28, 30, the endgate 18 may be tilted up. It will be understood that while in the present embodiment, the front cylinder is actuated while the rear cylinder is left un-actuated, in at least some embodiments, the rear cylinder may be actuated instead of the front cylinder, or in some other embodiments, both of the cylinders may be actuated to varying degrees to facilitate tilting of the endgates 18, 20.

Similar to the tilt-up mode, the tilt-down mode of the endgate 18 may be achieved by utilizing the tilt-down button 65 in a manner shown in FIG. 9. Specifically, the tilt-down mode may begin by an operator actuating (e.g., depressing) the tilt-down button 65 on the control device 36 at a step 126, which sends a command (e.g., digital signal) to the controller 40 at a step 128. The controller 40, at a step 130, may read and decode the signal and determine a unique binary code corresponding to the signal from the control device 36. At a step 132, the controller 40 may actuate the control valve 32 by activating appropriate ones of its associated solenoids to meter flow to the cylinders 28 and 30. In response to the command from the controller 40, at a step 134, the control valve 32 may meter flow to the front one of the cylinders 28, 30 in order to push the front tip of the endgate 18 down towards the ground (e.g., in a direction shown by the arrow 31) for tilting the endgate down. Again, the rear one of the cylinders 28, 30 may be left un-actuated. In at least some other embodiments, the rear cylinder may be actuated, while the front cylinder may be left un-actuated, or both cylinders may be actuated to varying degrees to facilitate the tilting down of the endgates 18, 20.

Thus, by utilizing the control device 36, the endgate 18 may be controlled to raise, lower, operate in an auto-on mode or tilted up and down. It will be understood again that while the description above has been explained with respect to the endgate 18, similar teachings will be applicable to the endgate 20.

It will be understood that while the cylinders 28, 30, as well as the control valves 32 and 34 have been described as being electrohydraulically controlled, in at least some embodiments, these elements may be electrically controlled, or controlled by way of other mechanisms that are commonly employed in work machine settings (i.e. electrically controlled screw actuators).

By virtue of controlling the endgates 18 and 20 by way of the control devices 36 and 38, an operator can adjust endgate settings constantly throughout the day as needed while walking along the screed assembly, thereby providing a safe and fast mechanism for controlling the endgates. Furthermore, the control valves may be designed to provide two downward pressure settings—one at a higher setting to power the endgates down in the down mode and break loose if stuck due to asphalt material build-up and a second lower setting with just enough pressure to maintain contact with the ground in the float or auto-on mode of the endgates. In addition, a series of interlock or machine conditions may be programmed and employed as an electronic safeguard.

The hydraulic cylinders also remove the need for manual handcrank operation of the endgate shoe and may be operated remotely while walking along the screed and observing the reference ground. The above system and method may be easily retrofitted into existing paving screed systems or may be offered as original equipment on new paving screed systems.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A system for controlling operation of an endgate of a screed paving machine, the system comprising:

at least one endgate having a frame and a wall connected to the frame and moveable relative to the frame and a screed element of the screed paving machine;

a pair of cylinders configured to operate the at least one endgate by moving the wall of the at least one endgate relative to the frame a wherein the pair of cylinders are actuated simultaneously to raise and lower the wall, and at least one cylinder of the pair of cylinders is actuated to effect tilting of the wall;

at least one control valve for actuating the at least one cylinder; and at least one control device for issuing commands by an operator for controlling operation of the at least one endgate and the position of the wall relative to the frame, the at least one control device configured to communicate with a controller, the controller in turn configured to communicate with the at least one control valve for actuating the at least one cylinder, the at least one control device having a plurality of endgate controls for controlling the at least one endgate in an up mode and a down mode to move the wall relative to the frame, changing the fore/aft pitch of the wall of the at least one endgate in a tilt-up mode and a tilt-down mode and operating the at least one endgate in an auto-on mode and an auto-off mode to move the wall relative to the frame.

2. The system of claim 1, wherein the at least one endgate comprises a left endgate and a right endgate.

3. The system of claim 2, wherein the pair of cylinders comprises a first pair of cylinders and a second pair of cylinders, the first pair of cylinders associated with the left endgate and the second pair of cylinders associated with the right endgate.

4. The system of claim 2, wherein the at least one control device comprises two hand-held control devices, a first hand-held control device for controlling the left endgate and a second hand-held control device for controlling the right endgate.

5. The system of claim 4, wherein each of the two hand-held control devices is configured to communicate with its own dedicated controller.

6. The system of claim 1, wherein the at least one control valve is an electrohydraulic control valve.

7. The system of claim 1, wherein the at least one control valve includes two down pressure settings including a higher setting to power the at least one endgate in the down mode and a lower setting to maintain contact with a ground line in the auto-on mode.

8. The system of claim 1, wherein the up mode is actuated by an up button , the down mode is actuated by a down button, the tilt-up mode is actuated by a tilt-up button, the tilt-down mode is actuated by a tilt-down button and the auto-on and auto-off modes are actuated by an auto button.

9. The system of claim 8, wherein the auto-on is actuated by actuating the auto button once and the auto-off mode is actuated by actuating the auto button again when the auto-on mode is turned on.

10. A method of controlling operation of an endgate of a screed paving machine, the method comprising:

providing (a) at least one endgate having a frame and a wall connected to the frame and moveable relative to the frame and a screed element of the screed paving machine; (b) a pair of cylinders configured to operate the at least one endgate by moving the wall of the at least one endgate relative to the frame, wherein the pair of cylinders are actuated simultaneously to raise and lower the wall, and at least one cylinder of the pair of cylinders is actuated to effect tilting of the wall and (c) at least one control device having a plurality of endgate controls for issuing commands by an operator for remotely controlling operation of the at least one endgate and the position of the wall relative to the frame, the plurality of endgate controls configured to control the at least one endgate in an up mode and a down mode to move the wall relative to the frame, changing the fore/aft pitch of the wall of the at least one endgate in a tilt-up mode and a tilt-down mode and operating the at least one endgate in an auto-on mode and an auto-off mode to move the wall relative to the frame;

actuating at least one of the plurality of endgate controls by the operator and sending a first command to a controller in communication with the at least one control device; and sending a second command by the controller to operate the at least one endgate in one of the up mode, the down mode, the auto-on mode, the auto-off mode, the tilt-up mode and the tilt-down mode.

11. The method of claim 10, wherein controlling the at least one endgate in the up mode comprises:

actuating an up button on the at least one control device and sending a first signal to the controller;

sending a second signal by the controller to at least one control valve; and metering flow by the at least one control valve to the at least one cylinder associated with the at least one endgate to raise the at least one endgate.

12. The method of claim 10, wherein controlling the at least one endgate in the down mode comprises:

actuating a down button on the at least one control device and sending a first signal to the controller;

sending a second signal by the controller to at least one control valve; and metering flow by the at least one control valve to the at least one cylinder associated with the at least one endgate to lower the at least one endgate.

13. The method of claim 10, wherein controlling the at least one endgate in the tilt-up mode comprises:

actuating a tilt-up button on the at least one control device and sending a first signal to the controller;

sending a second signal by the controller to at least one control valve; and metering flow by the at least one control valve to the at least one cylinder associated with the at least one endgate to tilt a front tip of the at least one endgate up.

14. The method of claim 10, wherein controlling the at least one endgate in the tilt-down mode comprises:

actuating a tilt-down button on the at least one control device and sending a first signal to the controller;

sending a second signal by the controller to at least one control valve; and metering flow by the at least one control valve to the at least one cylinder associated with the at least one endgate to tilt a front tip of the at least one endgate down.

15. The method of claim 10, wherein controlling the at least one endgate in the auto-on mode comprises:

actuating an auto button on the at least one control device and sending a first signal to the controller;

determining by the controller whether a set of interlock conditions are met;

sending a second signal by the controller to at least one control valve if the set of interlock conditions are met; and constantly regulating a down pressure by the at least one control valve to maintain contact of the at least one endgate with a ground line.

16. The method of claim 15, further comprising sending a third signal by the controller to the at least one control device for turning on a light emitting diode on the at least one control device for indicating the auto-on mode.

17. The method of claim 10, wherein controlling the at least one endgate in the auto-off mode comprises:

actuating an auto button on the at least one control device and sending a first signal to the controller;

sending a second signal by the controller to at least one control valve; and returning the at least one control valve to a neutral state.

18. A control system for remotely controlling operation of an endgate of a screed assembly, the control system comprising:

a control device comprising a plurality of endgate controls including an up button, a down button, a tilt-up button, a tilt-down button and an auto button for at least one of raising, lowering and tilting a wall of the endgate connected at either ends of the screed assembly, wherein the wall is connected to a frame of the endgate and is moveable relative to the frame and a screed element of the screed paving machine a pair of cylinders configured to operate the at least one endgate by moving the wall of the at least one endgate relative to the frame, wherein the pair of cylinders are actuated simultaneously to raise and lower the wall, and at least one cylinder of the pair of cylinders is actuated to effect tilting of the wall; and a controller in communication with the control device, the controller configured to receive commands from the control device and further configured to send commands to control operation of the endgate.

19. The control system of claim 18, wherein the plurality of endgate controls further comprise a light emitting diode for indicating whether the endgate is being operated in an auto mode.

20. The control system of claim 18, wherein the controller safeguards the endgate from unexpected motion.

* * * * *